United States Patent [19]

Krook et al.

[11] Patent Number: 4,729,759

[45] Date of Patent: Mar. 8, 1988

[54] CENTRIFUGAL SEPARATOR ARRANGED FOR DISCHARGE OF A SEPARATED PRODUCT WITH A PREDETERMINED CONCENTRATION

[75] Inventors: Göran Krook; Per Karlsson, both of Stockholm, Sweden

[73] Assignee: Alfa-Laval Separation AB, Tumba, Sweden

[21] Appl. No.: 16,740

[22] Filed: Feb. 20, 1987

[30] Foreign Application Priority Data

Mar. 12, 1986 [SE] Sweden ..... 8601153

[51] Int. Cl.[4] ..... B04H 11/02

[52] U.S. Cl. ..... 494/4; 494/56; 494/43

[58] Field of Search ..... 494/2–4, 494/43, 56, 6, 10, 23, 35, 37; 210/787, 790

[56] References Cited

U.S. PATENT DOCUMENTS

| | | | |
|---|---|---|---|
| 3,079,070 | 2/1963 | Thylefors | 494/3 |
| 3,250,462 | 5/1966 | Thylefors | 494/35 |
| 3,468,475 | 9/1969 | Thylefors | 494/37 |
| 4,067,494 | 1/1978 | Willus et al. | 494/35 |
| 4,151,950 | 5/1979 | Gunnewig | 494/2 |
| 4,162,760 | 7/1979 | Hill | 494/10 |
| 4,278,200 | 7/1981 | Gunnewig | 494/10 |

*Primary Examiner*—Harvey C. Hornsby
*Assistant Examiner*—Stephen Gerrity
*Attorney, Agent, or Firm*—Davis, Hoxie, Faithfull & Hapgood

[57] ABSTRACT

The invention resides in the provision of a sludge recirculation controlled in this manner within the centrifuge rotor itself. For this reason there has been arranged centrally in the rotor, apart from a previously known reception chamber (10) for separated sludge, a recirculation chamber (14) to which sludge is transferred from the reception chamber (10). An overflow outlet (15) maintains a free liquid surface in the recirculation chamber (14) at a predetermined radial level. Recirculation channels (16), which are formed so that the flow therethrough will automatically be controlled depending upon the viscosity of the separated sludge, will conduct such sludge from the recirculation chamber (14) back to the radially outermost parts of the separation chamber (5).

7 Claims, 4 Drawing Figures

CENTRIFUGAL SEPARATOR ARRANGED FOR DISCHARGE OF A SEPARATED PRODUCT WITH A PREDETERMINED CONCENTRATION

The present invention relates to a centrifugal separator of the kind comprising a rotor, which forms a separation chamber with an inlet for a mixture of components to be separated, with a first outlet for a separated sludge impoverished component and with a second outlet with flow restricting means for a separated sludge enriched component, means being arranged for recirculating part of the separated sludge enriched component having flowed through said flow restricting means for a renewed through-flow thereof, which recirculation means forms one or more recirculation passages arranged for a flow of the sludge enriched component such that the recirculation decreases upon increasing viscosity and increases upon decreasing viscosity of the component.

A centrifugal separator of this kind is shown in the U.S. Pat. No. 4,162,760. The known centrifugal separator has a rotor with outlet nozzles along its periphery forming the outlets of the separation chamber for separated sludge enriched component. Outside the centrifuge rotor there is a reception vessel with an overflow outlet and a bottom outlet, the latter being in communication with a passage for recirculation of part of the separated sludge enriched component to the centrifuge rotor. The recirculation passage is formed such that it lets through a flow that increases upon decreasing viscosity and decreases upon increasing viscosity of the separated sludge enriched component.

The arrangement according to U.S. Pat. No. 4,162,760 is intended to provide a constant concentration of the separated sludge enriched component leaving the centrifugal separator through the overflow outlet of the reception vessel.

The arrangement thus known requires a relatively large volume of the said reception vessel which extends around the whole of the rotor. This means that the concentration control can not be made as accurate as desirable, since it takes substantial time for separated sludge enriched component to flow from the outlet of the separation chamber, i.e. said nozzles, to the viscosity sensitive recirculation passage at the bottom of the reception vessel. Further, the known arrangement requires a large space and is expensive.

A first object of the present invention is to provide a centrifugal separator of the initially defined kind, by means of which a concentration control could be obtained, as to the separated sludge enriched component, which is substantially more accurate than the one obtainable by means of an arrangement according to U.S. Pat. No. 4,162,760.

Another object of the invention is to provide such a more accurate concentration control by means of equipment which is less complex, less expensive and less space requiring than the corresponding equipment according to U.S. Pat. No. 4,162,760.

These objects may be obtained by a centrifugal separator of the initially defined kind having means in the rotor forming a reception chamber for separated sludge enriched component, which reception chamber communicates with the separation chamber through the said second outlet thereof; means arranged to remove separated sludge enriched component from the reception chamber for maintaining a liquid level therein so low that a flow of sludge enriched component is obtained from the separation chamber to the reception chamber; means in the rotor forming a recirculation chamber from which said recirculation passage or passages start; means arranged to transfer sludge enriched component from the reception chamber to the recirculation chamber; and means arranged to maintain a liquid surface at a predetermined level in the recirculation chamber close enough to the rotor axis for the obtainment of a flow of sludge enriched component from the recirculation chamber and out through the recirculation passage or passages.

By this invention the entire concentration control equipment may be arranged within the rotor. Further, both the reception chamber and the recirculation chamber may be given a very small total volume and may communicate directly with the separation chamber. A change of the concentration of the flow leaving the separation chamber through said second outlet, thereby, will immediately influence the viscosity sensitive flow in the recirculation passage or passages. As a consequence thereof the concentration control will be very accurate.

By the invention it is further obtained automatically by the centrifugal force a substantially larger pressure difference across said recirculation passage or passages than is possible to accomplish in the arrangement according to U.S. Pat. No. 4,162,760. The recirculation passage or passages, thereby, more readily may be formed such that a desired laminar flow is obtained therein for sure.

The means for maintaining the liquid surface at the desired level in the recirculation chamber may comprise paring members or the like. By means of such members the liquid level if required may be moved radially during the operation of the rotor. This can be performed for instance by moving the paring member radially within the centrifuge rotor, or by actuating an adjustable throttle valve in the liquid channel of the paring member to let out a larger or smaller flow through the paring member.

However, if there is no need for any movement of the liquid level in the recirculation chamber, the means for determining of the liquid level therein is preferably constituted by an overflow outlet. This overflow outlet may either lead directly to a stationary collection vessel outside the centrifuge rotor or lead to an outlet chamber within the centrifuge rotor, from which it can be conducted away by means of a paring member or the like.

According to a particular embodiment of the invention the overflow outlet, instead, leads to the previously mentioned reception chamber, one and the same member being arranged to remove separated sludge enriched component from the reception chamber and to conduct part of it into the recirculation chamber and the rest of it out of the centrifuge rotor.

The member or members for removing separated sludge enriched component from the reception chamber preferably comprises a paring member or the like. Thereby, if desirable, the liquid level in the reception chamber may be moved radially during the operation of the rotor in the same manner as described above in connection with the liquid level in the recirculation chamber.

The invention is described below with reference to the accompanying drawing.

In FIG. 1 there is shown a first embodiment of the invention.

Figure 1:
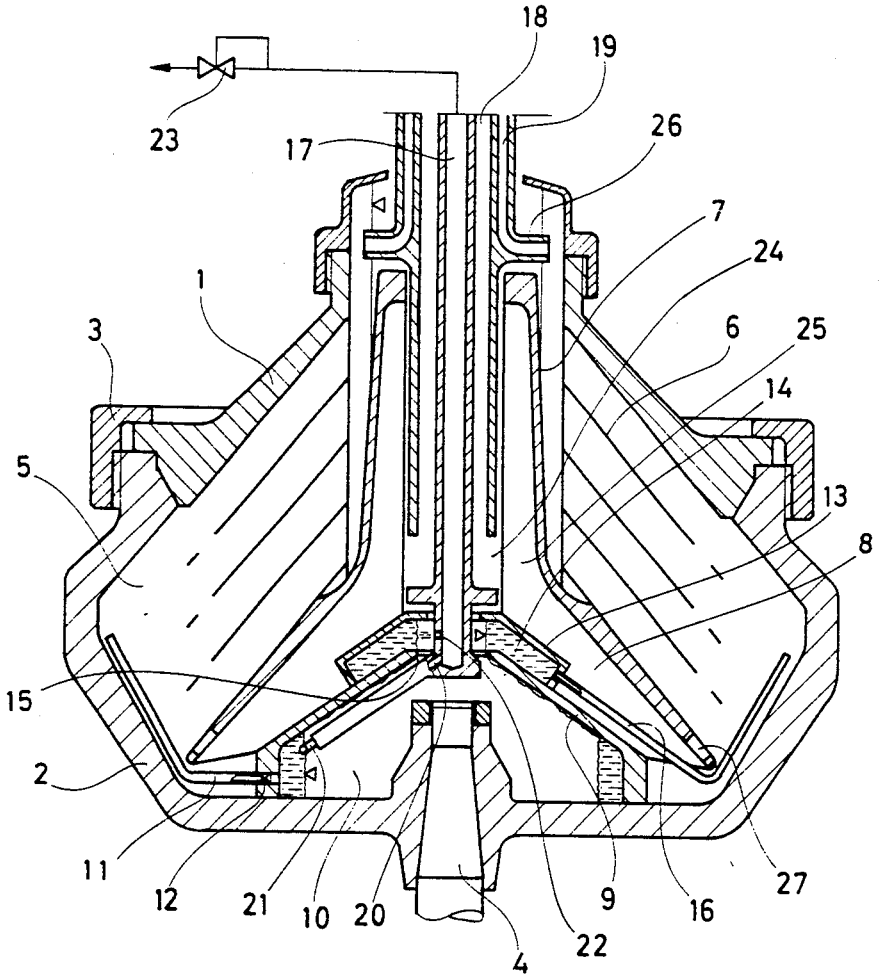

In FIG. 1 there is shown a centrifuge rotor composed by two parts 1 and 2, which are held together axially by means of a locking ring 3. The rotor is supported by a vertical drive shaft 4 connected with the rotor part 2.

Within the rotor there is formed a separation chamber 5 in which there is arranged a pile of conical separation discs 6. These are resting on the lower part of a so called distributor 7, which in turn through radially extending wings 8 rests upon a partly conical partition 9 supported by the rotor part 2.

Between the rotor part 2 and the partition 9 there is formed a central chamber 10 which through several radially extending pipes 11—connected with the partition 9—communicates with the radially outermost parts of the separation chamber 5. Each pipe 11 has a throttle 12 at its radially innermost end.

A further partition 13 with smaller radial extension than the partition 9 is connected with the latter such that a radially inward open annular chamber 14 is formed between the partitions 9 and 13.

The lower partition 9 has a central opening, and the annular edge of the partition 9 formed thereby is forming an overflow outlet 15 from the chamber 14 to the chamber 10. Even the partition 13 has a central opening, the diameter of which is smaller than that of the opening through the partition 9, however.

The chamber 14 through pipes 16—connected with the partition 13—communicates with the radially outermost parts of the separation chamber 5. The pipes 11 and 16 are evenly distributed around the rotor axis, so that each pipe 11 is situated between two adjacent pipes 16.

The pipes 11 have a substantially larger internal diameter than the pipes 16, and the previously mentioned throttles 12 of the pipes 11 (see FIG. 2) are entirely determining for the flow through the pipes 11. Each throttle 12 has a very small extension in the through-flow direction, so that viscosity changes expected during operation of a separated sludge enriched component flowing through the pipes 11 should not influence the through-flow to a substantial degree.

In contrast thereto each pipe 16 along the whole of its length has a through-flow area which is so small in relation to its length that a flow of separated sludge enriched component through the pipes 16 to a substantial degree is influenced by the viscosity of the component. Thus, an increasing viscosity will result in a decreased flow through the pipes 16 during otherwise unchanged conditions.

Axially into the centrifuge rotor there is extending a stationary member having one central channel 17 and two annular channels 18 and 19, respectively, situated coaxially there around.

The central channel 17 constitutes an outlet channel and communicates through an opening 20 with the interior of a paring tube 21 extending into the chamber 10. Opposite to the annular chamber 14 there is a small opening 22 in the stationary member, which provides for a small flow from the channel 17 out into the chamber 14.

In the channel 17 outside the rotor there is a constant pressure valve 23 shown schematically in FIG. 1. A similar valve (not shown) may be arranged in the outlet channel 19 for the separated liquid.

The channel 18 constitutes an inlet channel and communicates through openings 24 with a central inlet chamber 25 in the rotor. The channel 19 constitutes an outlet channel and communicates with the interior of a paring disc 26.

The central inlet chamber 25 communicates with the separation chamber 5 through the spaces between the radial wings 8 and through holes 27 in the lower part of the distributor 7.

The arrangement according to FIG. 1 is intended to operate in the following manner upon separation of sludge, for instance yeast, from a liquid.

The mixture of sludge and liquid is introduced through the channel 18 into the rotor inlet chamber 25, from where it flows further on between the wings 8 and through the holes 27 to the separation chamber 5. Therein the sludge is separated and collected at the radially outermost parts of the separation chamber, in the so called sludge space, while the clarified liquid flows towards the rotor centre and is continuously discharged from the rotor through the paring disc 26 and the outlet channel 19.

Sludge having been collected in the sludge space flows further on—mixed with a small amount of liquid—radially inward through the so called concentrate pipes 11 to the reception chamber 10. From there the sludge is pared off through the paring tube 21 to the outlet channel 17 and further out of the rotor.

Part of the sludge leaves the outlet channel 17 through the hole 22 and flows to the chamber 14. From there part of it flows further through the recirculation pipes 16 to the peripheral parts of the separation chamber 5, i.e. to the so called sludge space, whereas excess sludge flows over the overflow outlet 15 back to the reception chamber 10. During operation the constant pressure valve 23 is automatically controlled such that the free liquid surface in the reception chamber 10 is maintained by the paring tube 21 at a predetermined radial level. In a corresponding manner a free liquid surface of the clarified liquid is maintained in the rotor at a radial level more close to the rotor axis. Hereby the said transportation of sludge from the sludge space through the concentrate pipes 11 to the reception chamber 10 is accomplished.

By the fact that the valve 23 maintains a constant pressure in the outlet channel 17—independent of the flow through the channel 17—a constant flow of sludge is obtained through the hole 22 to the recirculation chamber 14. It is assumed here that the extension of the hole 22 in the flow direction is so short that the flow therethrough is substantially independent of occurring changes of the sludge viscosity.

However, depending upon occurring changes of the sludge viscosity (concentration) more or less of the sludge entering the chamber 14 will flow back to the sludge space through the pipes 16 or flow across the overflow outlet 15 back to the chamber 10, respectively. If the viscosity increases, a smaller part of the sludge will flow back through the pipes 16, while the flow across the overflow outlet 15 increases.

Thus, if the viscosity and as a consequence the flow across the overflow outlet 15 increases, the outflow of sludge through the paring tube 21 and the outlet channel 17 also increases.

Figure 2:
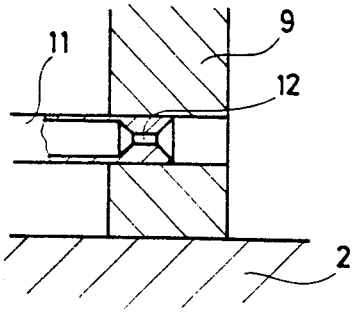
FIG. 2 shows an enlarged part of FIG. 1.

In FIG. 2 there is shown in an enlarged scale the connection of the concentrate pipe 11 to the reception chamber 10. From this the flow determining throttle 12 can be seen more clearly than in FIG. 1.

Figure 3:
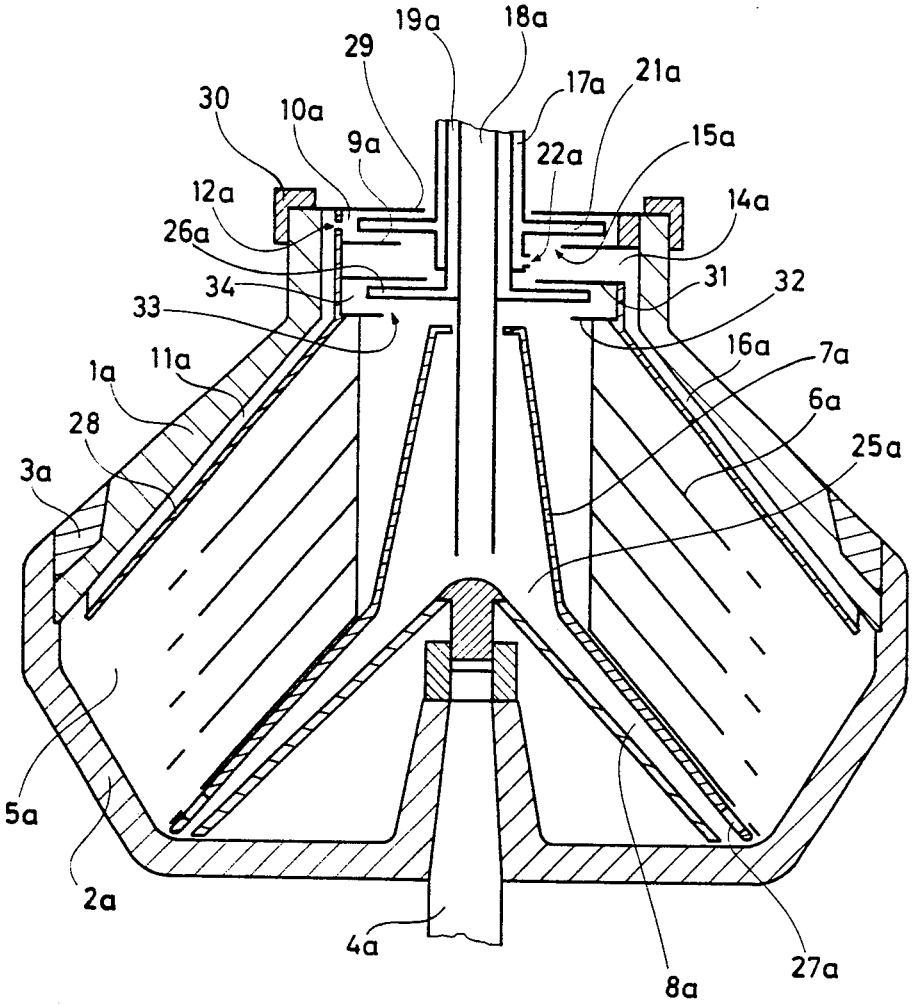
FIG. 3 shows a second embodiment of the invention.

In FIG. 3 there is shown an alternative embodiment of the invention, according to which the reception chamber and the recirculation chamber are arranged at the top instead of at the bottom of the centrifuge rotor. Details in FIG. 3 having counterparts in FIG. 1 have been given the same reference numerals in FIG. 3 with the addition of a.

An additional member in this embodiment is constituted by a conical so called top disc 28 having a larger radial extension than the separation discs 6a. The concentrate channels 11a as well as the recirculation channels 16a are formed between the top disc 28 and the upper rotor part 1a, for instance by radial grooves in the upper side of the top disc 28.

Another additional member is constituted by an upper annular end wall 29 which is kept on place at the rotor part 1 by means of a locking ring 30. The end wall 29 forms together with the partition 9a the reception chamber 10a.

Further additional members are constituted by two annular partitions 31 and 32. The partition 31 forms together with the partition 9a the recirculation chamber 14a. The partition 32 forms an annular overflow outlet 33 from the separation chamber 5 to a paring chamber 34 around the paring disc 26a for clarified liquid.

The arrangement according to FIG. 3 is intended to operate in the following manner.

A sludge containing liquid mixture is supplied to the rotor through the inlet channel 18a and flows through the reception chamber 25a and the holes 27a into the separation chamber 5a. While clarified liquid leaves the separation chamber 5a through the overflow outlet 33, the paring chamber 34, the paring disc 26a and the outlet channel 19a, separated sludge flows from the sludge space into and through the concentrate channels 11a. From there the sludge flows further through the throttles 12a into the reception chamber 10a, from where it is pared off by means of the paring disc 21a. Part of the sludge leaves the rotor through the outlet channel 17a, while the rest of it is conducted through the opening 22a to the recirculation chamber 14a. From there part of the sludge flows back to the sludge space through the recirculation channels 16a, while the rest of it flows across the overflow outlet 15a directly back to the reception chamber 10a.

With a constant pressure valve arranged in the outlet channel 17a (similar to the valve 23 in FIG. 1) the arrangement for the rest operates as has been earlier described in connection with FIG. 1. For avoiding obscurities no liquid levels have been shown in FIG. 3. As can be understood, however, the liquid level in the separation chamber 5a is determined by the position of the overflow outlet 33 and in the recirculation chamber 14a by the position of the overflow outlet 15a. The latter is situated at a smaller radius than the former. Further, it is intended that the liquid level in the reception chamber 10a is maintained radially outside the liquid level in the separation chamber 5a by means of the above mentioned constant pressure valve (not shown) in the outlet channel 17a.

Figure 4:
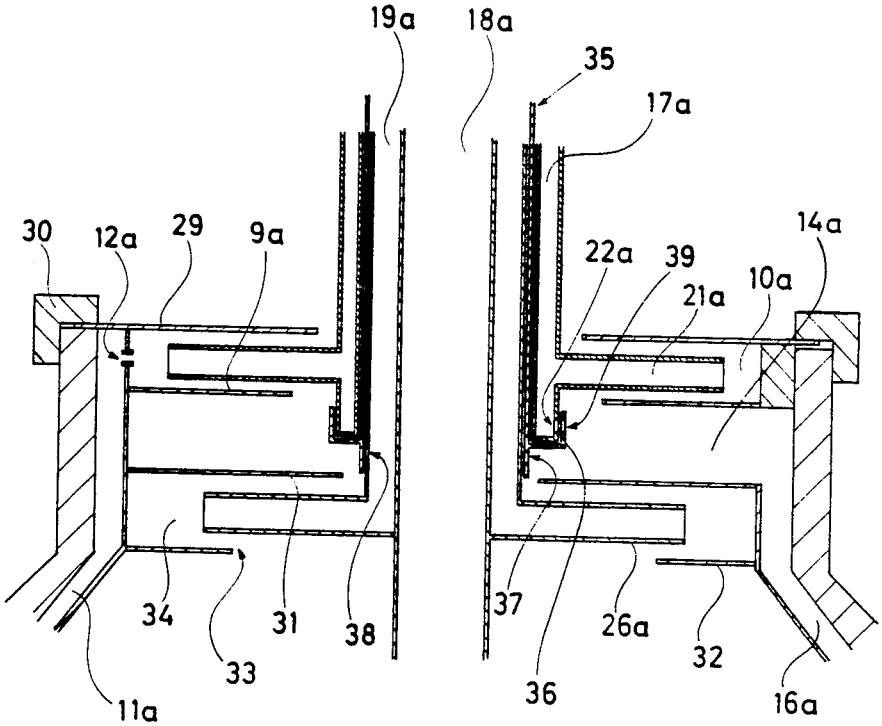
FIG. 4 shows a device for simplifying cleaning of a centrifuge rotor designed according to FIG. 3.

In FIG. 4 there is shown a part of the arrangement in FIG. 3, the same reference numerals being used for corresponding details. One single member has been added in FIG. 4, that is an annular slide 35, which is turnable around its own and the rotor axis. The slide 35 has a tubular part which is arranged radially between the annular walls defining the outlet channels 17a and 19a, respectively. At its lower end the tubular part of the slide 35 supports externally an annular groove 36 which is open upwards. Part of the member forming the outlet channel 17a extends from above down into this groove.

Below the groove 36 and in the area of the recirculation chamber 14a the tubular part of the slide 35 has a radial through bore 37. In the radially opposite direction the outer wall of the outlet channel 19a has a similar through bore 38.

In the groove 36 the radially outer wall of the channel 17a has a radial through bore constituting the previously mentioned passage 22a, through which part of the separated sludge enriched component can be transferred from the reception chamber 10a through the channel 17a to the recirculation chamber 14a. For enabling such a transferance the radially outer side wall of the groove 36 has a corresponding through bore 39.

The slide 35 is used in the following manner:

During normal operation of the centrifuge rotor the slide 35 is maintained in its position shown in FIG. 4. The bores 22a and 39 are then situated opposite to each other, so that through-flow is possible from the channel 17a to the recirculation chamber 14a. Simultaneously the bore 38 is closed by the lower part of the slide 35.

When the centrifuge rotor is to be cleaned, the slide 35 is turned 180° around its axis, so that the lower bore 37 in the slide will be opposite to the bore 38. Simultaneously the bore 22a is covered by a non-perforated part of the side wall of the groove 36. Hereby it is prevented that part of the liquid having entered the reception chamber 10a from the radially outer parts of the separation chamber 5a is returned to the separation chamber through the recirculation chamber 14a and the channels 16a. All such liquid is instead conducted out of the rotor through the outlet channel 17a.

However, part of the liquid having left the separation chamber 5a through the overflow outlet 33, the chamber 34 and the channel 19a, is conducted out through the bores 38 and 37 to the recirculation chamber 14a, so that this chamber and the recirculation channels 16a will be rinsed.

Within the scope of the invention every throttle 12 (FIGS. 1 and 2) or 12a (FIG. 3) may be substituted by a so called vortex nozzle of the kind described in U.S. Pat. No. 4,311,270. A nozzle of this kind can be formed in a way such that a liquid flow therethrough increases with increasing viscosity of the liquid, and decreases with decreasing viscosity of the liquid.

By means of vortex nozzles it is thus possible to provide an even more sensitive control of the concentration of the separated heavy component than can be obtained by means of conventional throttles 12 (alternatively 12a).

We claim:

1. Centrifugal separator comprising a rotor which forms a separation chamber (5) with an inlet (27) for a mixture of components to be separated, with a first outlet (26) for a separated sludge impoverished component and with a second outlet (11) with flow restricting means (12) for a separated sludge enriched component means being arranged for recirculation of part of the separated sludge enriched component having flowed through said flow restricting means (12) for renewed through-flow thereof, which recirculation means form one or more recirculation passages (16) arranged for such a flow of the sludge enriched component that the recirculation decreases upon increasing viscosity and increases upon decreasing viscosity of the component, characterized by means (9) in the rotor forming a reception chamber (10) for separated sludge enriched component, which reception chamber (10) communicates with the separation chamber (5) through the said second outlet (11) thereof, means (21) arranged to remove separated sludge enriched component from the reception chamber (10) for maintaining a liquid level therein so low that a flow of sludge enriched component is obtained from the separation chamber (5) to the reception chamber (10), means (13) in the rotor forming a recirculation chamber (14) from which said recirculation passage or passages (16) start, means (22) arranged to transfer sludge enriched component from the reception chamber (10) to the recirculation chamber (14), and means (15) arranged to maintain a liquid surface at a predetermined level in the recirculation chamber (14) close enough to the rotor axis for the obtainment of a flow of sludge enriched component from the recirculation chamber (14) and through the recirculation passage or passages (16).

2. Centrifugal separator according to claim 1, characterized in that the recirculation chamber (14) has an overflow outlet (15) for determining of the liquid level therein.

3. Centrifugal separator according to claim 2, characterized in that the reception chamber (10) is arranged to receive sludge enriched component from the overflow outlet (15) of the recirculation chamber (14).

4. Centrifugal separator according to claim 1, characterized in that said means (21) for removing sludge enriched component from the reception chamber (10) is an integral part of said means (22) for transferring of sludge enriched component from this to the recirculation chamber (14), so that part of the component removed from the reception chamber (10) is conducted into the recirculation chamber (14), while another part is conducted out of the rotor.

5. Centrifugal separator according to claim 1 characterized in that said flow restricting means (12) in the second outlet (11) from the separation chamber (5) is arranged for such a through-flow of separated sludge enriched component that the magnitude of the through-flow does not decrease upon increasing viscosity of the component.

6. Centrifugal separator according to claim 1, characterized in that the reception chamber (10) and the recirculation chamber (14) are both placed centrally within the rotor and are separately communicating with the radially outer parts of the separation chamber (5) through passages (11, 16) with a radial extension.

7. Centrifugal separator according to claim 6, characterized in that said passages (11, 16) are evenly distributed around the rotor axis in a way such that each passage (11) communicating with the reception chamber (10) is situated between two adjacent passages (16) communicating with the recirculation chamber (14).

* * * * *